United States Patent [19]

Brint et al.

[11] 4,387,524

[45] Jun. 14, 1983

[54] FIREARMS WITH RECHARGEABLE MAGAZINE

[75] Inventors: Norman T. Brint; Leon J. Williams, both of Waltham Abbey, England

[73] Assignee: The Secretary of State for Defence in Her Britannic Majesty's Government of the United Kingdom of Great Britain and Northern Ireland, London, England

[21] Appl. No.: 361,920

[22] PCT Filed: Jul. 1, 1981

[86] PCT No.: PCT/GB81/00118

§ 371 Date: Mar. 15, 1982

§ 102(e) Date: Mar. 15, 1982

[87] PCT Pub. No.: WO82/00346

PCT Pub. Date: Feb. 4, 1982

[30] Foreign Application Priority Data

Jul. 14, 1980 [GB] United Kingdom ..... 8022931

[51] Int. Cl.[3] ..... F41C 25/02; F41C 15/00; F41C 11/00; F41C 19/00

[52] U.S. Cl. ..... 42/18; 42/25; 42/69 A

[58] Field of Search ..... 42/18, 22, 87, 88, 6

[56] References Cited

U.S. PATENT DOCUMENTS 2,908,097 10/1959 Allyn ..... 42/18

*Primary Examiner*—Charles T. Jordan
*Assistant Examiner*—Ted L. Parr
*Attorney, Agent, or Firm*—Cushman, Darby & Cushman

[57] ABSTRACT

A firearm especially for firing large calibre rounds such as rubber bullets and having a magazine in which a plurality of rimmed rounds may be stacked in contact with one another, the magazine being rechargeable at any stage of depletion. The firearm includes a catch mechanism which locks a round in the breech on insertion, permits the rim of a round to ride forward over the rim of a previously-inserted round without fouling, and the extraction of a spent round rearwardly without its rim fouling a previously-inserted round. Mechanism for firing, automatic feed, and automatic extraction and ejection of spent rounds is described.

6 Claims, 6 Drawing Figures

FIREARMS WITH RECHARGEABLE MAGAZINE

Figure 2:
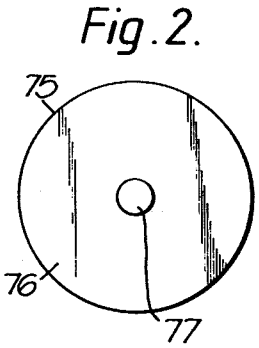

This invention relates to firearms, and in particular to a magazine for a firearm, especially one employing a rimmed round of ammunition.

Conventional practice is to provide a disposable magazine so that when one magazine is exhausted it is removed and replaced by a fresh magazine, already loaded with fresh ammunition. Unless he throws away a magazine which is only partially exhausted, the user may therefore run out of ammunition and be obliged to change magazines at an extremely inconvenient moment. Normally there has been no possibility of recharging a partially exhausted magazine without disengaging the magazine from the firearm. Where the firearm is for large calibre ammunition, this problem can be particularly acute because considerations of bulk prevent the use of a magazine capable of holding more than a few rounds.

In a conventional magazine in which rimmed rounds of ammunition are stacked one upon another, it is normally necessary that the rounds are stacked with the rims of rounds remote from the breech behind the rims of all rounds nearer to the breech, in order that upward and forward feeding of each round into a firing position is not hindered by interaction of the rims. This has generally prevented prior art magazines from having the facility for re-loading without removing the magazine from the firearm, although in one case known to the Applicant additional rounds could be loaded without removal of the magazine by use of a specially designed clip in which extra rounds were carried. The need for the special clip was, however, inconvenient, and this prior art arrangement was hence less than ideal.

An advantageous feature of the present invention is that it makes possible the provision of a magazine which can be re-loaded at any time with any number of rounds of ammunition up to its maximum capacity, without the necessity for removal of the magazine from the firearm, or for the use of any separate tool or device.

According to the present invention, there is provided a firearm including a body and having a magazine in which one or more rimmed rounds of ammunition may be stacked each in contact with an adjacent round;

resilient magazine bias means; a breech opening through which a round of ammunition may be inserted into the magazine, the breech opening defining transverse guide means through which a round can be inserted in a direction transversely of the barrel axis against the action of the magazine bias means, and restraining means which are effective on subsequent forward movement of the inserted round to restrain the round in the breech against the action of the magazine bias means;

a catch which can assume a locking position in which it prevents return of a round forwardly located in the breech to a position in which it can re-enter the transverse guide means;

further guide means by which a round in the breech can be guided in a direction transversely of the barrel axis and rearwardly into the magazine against the magazine bias means on insertion of a further round into the breech;

the catch being effective to keep separate the rims of one round and a subsequently inserted round during the insertion of the subsequently inserted round, whereby the subsequently inserted round when engaged in the breech has its rim forward of the rim of the said one round.

Conveniently the catch is pivotally mounted in the body and resiliently biased towards the locking position, the arrangement being such that on insertion of the round through the transverse guide means the catch is depressed against a resilient bias by contact with the round, and on forward movement of the inserted round the catch can spring back under its resilient bias to prevent rearward movement of the round to a position in which it can re-enter the transverse guide means.

Preferably the catch when depressed bears upon any round which is already present in the breech to keep the rim thereof separate from the rim of a subsequently-inserted round.

Normally the firearm comprises a breech block which can move forwardly to positively lock a round present in the breech in engagement with the breech end of the barrel.

Normally also the firearm has a firing pin moveable forwardly to strike the rear face of a round only when the breech block is in a forward position.

Preferably the firing pin has a mechanical interaction with the catch, such that the catch is held depressed when the firing pin is in a forward position. After firing, the catch can thus be held depressed while the spent case of the round is withdrawn.

In a convenient form of the invention the firearm includes an extractor assembly comprising, an extractor having a longitudinal slot therein by which the extractor is pivotally mounted on the breech block;

a hook portion at the forward end of the extractor for engaging in front of the rim of a round of ammunition in the breech; resilient means for biasing the extractor forwardly and for biasing the hook portion inwardly towards contact with a round of ammunition in the breech;

a first extractor stop for limiting forward movement of the extractor relative to the body to a position where the extractor hook engages in front of the rim of any round present in the breech;

extractor locking means for locking the extractor against longitudinal movement relative to the breech block when the breech block is withdrawn rearwardly after firing a round of ammunition, said extractor locking means being released when the breech block reaches a rearward position whereby the extractor can return under its resilient bias to a position in which the hook engages in front of the rim of a round subsequently entering the breech.

The locking means conveniently comprises a locking pin slideable transversely in the breech block, one end of the locking pin being arranged to contact a cam surface on the firing pin such that when the firing pin occupies a forward position relative to the breech block, the locking pin is extended to a position in which its other end can come against a second extractor stop on the extractor but when the firing pin occupies a rearward position relative to the breech block, the locking pin can retract to clear the second extractor stop, the arrangement further being such that if the hook portion moves inwardly under its resilient bias, as when no round is present in the breech, the locking pin can clear the second extractor stop regardless of the position of the firing pin.

Figure 1:
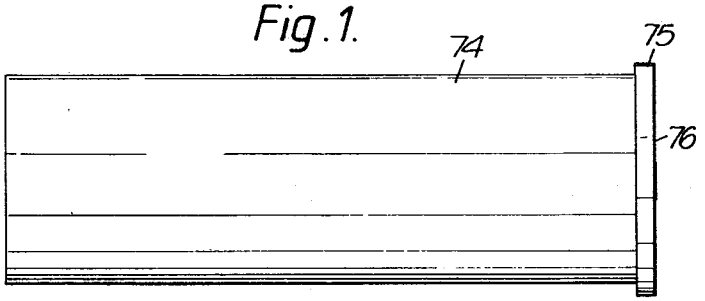
Figure 3:
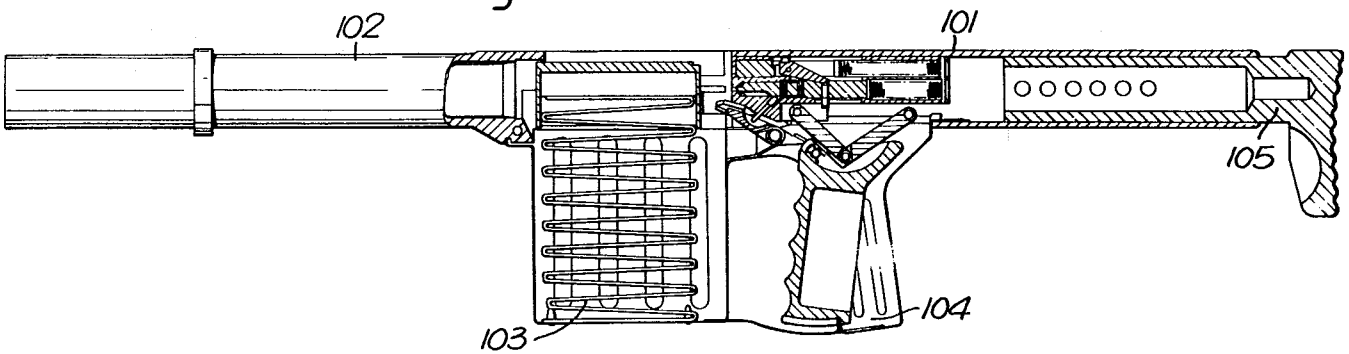
Figure 3A:
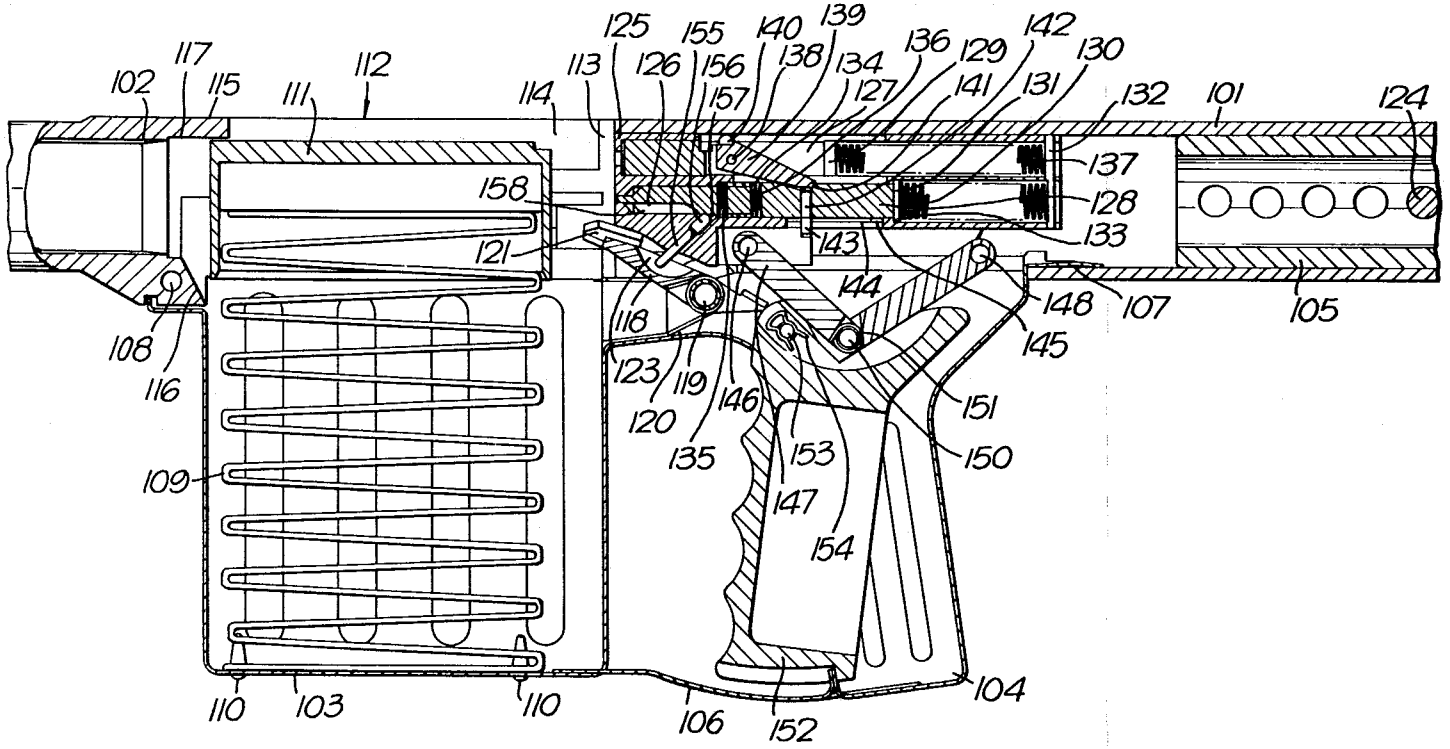
Figure 4:
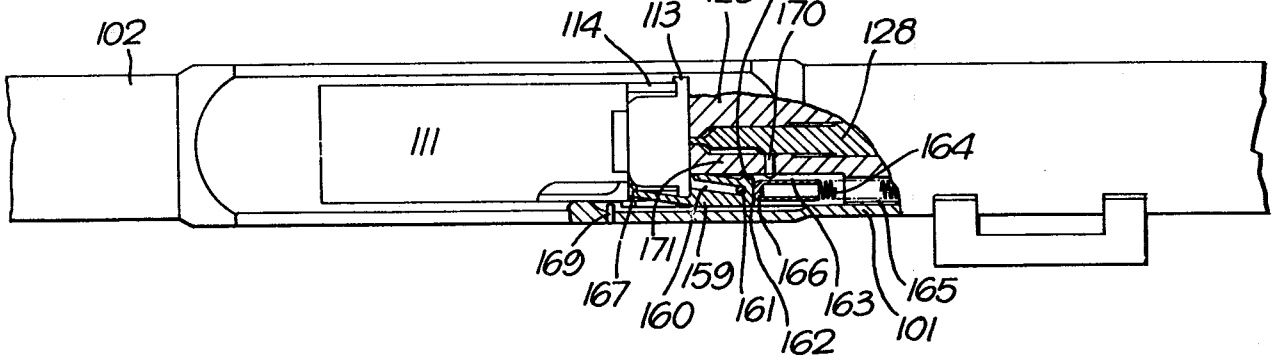
Figure 5:
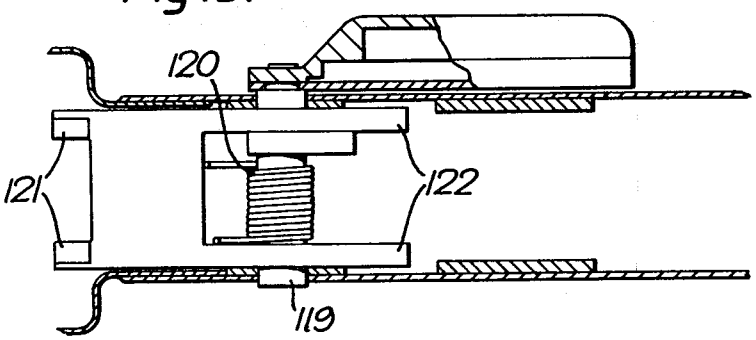

The invention will now be described by way of example only with reference to the accompanying drawings of which FIG. 1 is a side elevational view of a rimmed around of ammunition, FIG. 2 is an end elevational view of the round shown in FIG. 1, FIG. 3 is a sectional elevational view of a firearm in accordance with the invention, FIG. 3A shows a part of FIG. 1 to an enlarged scale, FIG. 4 is a plan view part in section, of a part of the firearm shown in FIG. 3, and FIG. 5 is a sectional view from below of a loading catch forming part of the firearm of FIG. 1.

The round for which the firearm is designed is shown in FIGS. 1 and 2. It comprises a cylindrical case 74 which contains a projectile (not shown) such as for example a so-called rubber bullet. The round is also provided with a projecting rim 75 at its rearward end, and in the rearward face 76 there is provided a percussion cap 77 by which the round may be fired. The case is designed so as to be substantially self-supporting ie insertion into a supporting chamber to prevent rupture of the case when the round is fired is unnecessary.

The embodiment of the invention shown in FIGS. 3 to 5, comprises a body 101 integral with a barrel 102, a magazine casing 103, a pistol grip 104 and an adjustable butt 105. The magazine casing 103 and pistol grip 104 are formed integrally as a steel pressing, and a trigger guard 106 is welded thereto. This assembly is attached under an opening in the body 101 by a tail 107 on the pistol grip and a transverse pin 108 passing through a forward projection (not shown) on the magazine casing.

The magazine casing 103 houses a wire spring 109 positioned in the base of the casing by riveted pins 110. Carried on the top of the spring 109 is a magazine platform 111 having an upper surface of semi-cylindrical general form. The platform 111 is hollow and can accommodate the compressed spring 109 when fully depressed into the casing 103.

An opening 112 is provided in the upper surface of the body 101 above the magazine casing, through which rounds of the type shown in FIGS. 8 and 9 may be inserted. A groove 113 is provided in each side wall of the opening to accommodate the rim 75, the adjacent wall portions near the upper edge of the opening 112 constituting cheeks 114 between which the cylindrical casing 74 of a round may pass, but the rim portion 75 may not. Below the cheeks 114, the opening widens to permit entry of a rim 75. At the forward end of the opening 112, the rearward end of the barrel 102 has an upper overhanging portion 115 beneath which the forward end of a round may be held, and a lower chamfered portion 116 which can guide a round downwards and rearwards into the magazine casing 103. The rearward end of the barrel also has a socket 117 constituting a short chamber into which the forward end of the casing 74 may be engaged prior to firing.

A loading catch 118 is pivoted at 119 in the steel pressing 103, 104 and is biased clockwise (as viewed in FIG. 3) by a spring 120. The loading catch 118 has a pair of limbs 121 which extend forwards into the opening 112, a pair of limbs 122 which extend rearwardly, and is provided with an arcuate depression 123 in its upper surface.

The rear portion of the body 101 is of generally cylindrical form, and a cylindrical portion of the adjustable butt 105 is slideable longitudinally therein so that the butt length may readily be adjusted to suit the user. The adjustable butt may be locked in a desired position by insertion of the butt locking pin 124 through holes provided in the body 101 and the butt 105.

Slideable longitudinally in the body 101 in front of the butt 105 is a breech block 125 of generally cylindrical form. Slideable longitudinally within respective bores 126 and 127 in the breech block 125 are a firing pin 128 and a sear block 129. The firing pin can be biased forwardly relative to the breech block by a firing pin spring 130 having a thrust washer 131 at its forward end. The forward movement of the spring 130 is limited by the washer 131 coming into contact with a shoulder 133 in the bore 126. The spring 130 is held within the bore 126 at its rearward end by a cross pin 132 located at the rear end of the breech block. A relatively weak firing pin return spring 134 acts between a shoulder 135 and the bore 126 and a shoulder 136 on the firing pin 128, to urge the firing pin rearwards.

The sear block 129 is urged forward by a sear spring 137 whose rearward end also reacts against the cross pin 132. Pivoted on a transverse sear pivot 138 within a longitudinal slot in the sear block 129 is a sear 139. The sear has a bent on its upper edge which engages with a transverse pin 140 located in the body 101. The sear also has a nose which can engage with a bent 141 in the firing pin 128. A sear pin 142 is slideable vertically in a bore which passes through the firing pin beneath the sear bent. The sear pin 142 is of generally cylindrical form, but has a reduced diameter portion 143 which can slide longitudinally within a longitudinal slot 144 in the breech block 125. During assembly, the pin 142 can enter the slot 144 through a keyhole 145, but cannot escape thereform during normal operation of the firearm. The pin can move vertically between limits determined by the length of the reduced diameter portion and the depth of the slot 144.

Pivoted to the breech block 125 at 146 is a first toggle bar 147. Pivoted to the body 101 at 148 is a second toggle bar 149. The first and second toggle bars are pivoted to each other at 150 to constitute a toggle mechanism, which is biased downwardly by a toggle spring 151.

A trigger 152 is pivoted at 153 to the pistol grip 154, the pivot being retained by spring clip 154. The upper surface of the trigger is formed in the shape of a V, and the lower surface of the second toggle bar bears on the rearward "arm" of the V.

A pin 155 has an enlarged head 156 by which it is held captive in a stepped bore 157 in the breech block 125, which bore 157 is angled forwardly and down from the bore 126 through to the exterior of the breech block. The pin 155 is prevented from escaping upwardly and rearwardly from the bore 157 by contact with the underside of the firing pin 128. When the firing pin is in a rearward position relative to the breech block 125, the head 156 thereof can retract into a cam slot 158 in the forward underside of the firing pin, so that the lower end of the pin 155 can retract into the breech block. As the firing pin nears its most forward position relative to the breech block, an arcuate portion of the cam slot 158 pushes the pin 155 downwards so that it projects from the breech block.

As shown in FIG. 4, a floating extractor 159 has an open slot 160 therein by which it is held by means of a transverse pin 161 fixed in the breech block 125. The extractor 159 can slide longitudinally relative to the breech block in a groove 162 in the body 101 and a groove 163 in the side of the breech block, and can also pivot on the pin 161 to an extent permitted by the space available between the grooves 162 and 163. The extractor is urged forwardly by an extractor spring 164 engaged in a recess 165 in the breech block and acting through a plunger 166. The plunger 166 bears on a flat rear face of the extractor, which is so angled that the forward end of the extractor is biased towards a position somewhat inwards from the groove 162. The extractor 159 has an inwardly-directed hook 167 at its forward end and a small inwardly-directed projection 168 at its rearward end. A short pin 169 fixed in the body 101 projects into the groove 162 to obstruct movement of the extractor forwards therein beyond the pin.

A pin 170 is slideable transversely in a bore in the breech block which opens into the bore 126 and the groove 163. When the firing pin occupies a forward position relative to the breech block, the inner end of the pin 170 bears on the flank of the firing pin, so that the outer end of the pin 170 is forced to project into the groove 163. When the firing pin occupies a rearward position relative to the breech block, a recess 171 in the flank of the firing pin comes opposite the pin 170 so that it can retract from the groove 163.

The firearm is loaded by inserting a rimmed round of the type shown in FIGS. 1 and 2 in through the aperture 112, with the rim passing down through the grooves 113 and the forward end of the round passing behind the overhanging portion 115. This action depresses the magazine platform 111 and compresses the spring 109, and also as the rim 75 bears on the limbs 121, the loading catch 118 is depressed about it pivot. As the rim clears the cheeks 114, the round is given a forward movement so that the rim passes below the cheeks, and the forward end of the round passes under the overhanging portion 115. This frees the limbs 121 from under the rim 75 so that the loading arm springs up behind the rear face 76 of the round to prevent the round being drawn back again. The round in thus held captive under the overhang 115 and the cheeks 114, in alignment with the barrel 102. The round may now be fired as described hereinafter, or alternatively a second round may be inserted in the same way as the first.

It will be observed that when a second round is inserted through the opening 112, its rim will occupy a position behind that of the first round. For reasons which will become more clearly apparent hereinafter, the feeding of rounds from the magazine back to the firing position in the breech will be obstructed if the rounds are stored in the magazine with the rim of a second-inserted round behind that of the first. Accordingly it is an important function of the loading catch 188 that it ensures that the first-inserted rounds enters the magazine with its rim behind that of the second.

This is achieved as follows. The second round is inserted on the top of the first round with its rim in grooves 113. As the second round is pushed down, the first round is guided downwards and rearwards by the chamfer 116. At this point the rim of the second round depresses the loading catch 118 onto the rim of the first round, thus enabling the second round rim to pass over the rim of the first round when pushed forward engaging under cheeks 114. As the second inserted round moves down and forward, the loading catch 118 snaps up behind it locking the second round forward in the breech in the same way as the first. The first round now occupies a position in the magazine casing with the second round resting on top of it and holding it down against the spring 109, the rim of the second in front of that of the first.

The second round may now be fired as described hereinafter, or a third round may be inserted in the same way as the second. If a third round is inserted, the final position will be with the front and second rounds in the magazine, biased upwardly by the spring 109, and the third round resting on top of the second and holding it down. The third round will be in the breech, its forward end under the overhanging portion 115, its rim under the cheeks 114, and the arms 121 preventing its escape rearwards. The rim of the third round will be in front of the rim of the second round.

When the trigger 152 is pulled against the pistol grip 104, it pivots rearwardly about the pivot 153. The upper surface of the trigger bears against the second toggle bar 149, forcing it upwards and so straightening the toggle mechanism comprising the toggle bars 147, 149. As the toggle mechanism straightens, the breech block 125 is pushed forwards, but the firing pin 128 is restrained from forward movement by engagement with the sear 139. As the breech block moves forward, the spring 130 is compressed between the pin 132 and the firing pin 128, and the spring 137 is compressed between the pin 132 and the sear block 129 held on the pin 140. If there is a round in position aligned with the barrel, forward movement of the breech block also pushes the round into positive engagement in the socket 117, the rim of the round sliding on the cheeks 114 against which it is held by the bias of the spring 109. As the round nears full engagement in the socket 117, the toggle bars 147, 149 reach the straight position and pass slightly over centre to lock the breech block 125 positively in a forward position. At the same time the upper surface of the first toggle bar 147 contacts the pin 142 and pushes it upwards to disengage the sear 139 from the bent 141 on the firing pin 128. The firing pin is thus freed to shoot forward at high speed under the action of the spring 130; and strike the percussion cap 77 of the round to fire it. It will be observed that in the position illustrated the spring 130 rests on the shoulder 133 (via the washer 131), but the tip of the firing pin remains within the breech block. The firing pin thus completes its forward movement under its own inertia, compressing the light restoring spring 134. The spring 134 then retracts the firing pin immediately after firing, so that its tip lies within the breech block clear of the percussion cap 77, where it cannot interfere with ejection of the spent case. When the trigger is released after firing, the toggle mechansim is pulled back from its over-centre position by the spring 151, and the breech block is retracted by the spring 137 compressed between the pin 132 and the sear block 129.

The extractor claw 159 is effective only when a round is present in the breech. At other times, the forward end of the extractor is angled inwardly under the bias action of the spring 164 on its rear face, so that it always clears the pin 169, and simply moves back and forth in unison with the breech block 125. When the extractor 159 is thus angled inwardly, the projection 168 can clear the pin 170 even when the pin 170 is fully extended by contact of its inner end with the flank of the firing pin 128.

When a round is introduced in front of the breech block 125, however, the rim 75 thereof contacts the extractor behind the hook 167 to push its forward end outwardly into the groove 162. In this orientation, the projection 168 cannot clear the pin 170 when fully extended by contact of its inner end with the flank of the firing pin, and forward movement of the extractor is limited by contact with the pin 169.

When the trigger is operated with a round in position in front of the breech block, the extractor 159 moves forward with the breech block 125 until the extractor contacts the pin 169. As the breech block moves forward further, the extractor is prevented from doing so, and the pin 161 slides along the slot 160 in the extractor, the rear end of the extractor bearing on the plunger 166 to compress the spring 164. At this stage of the firing sequence, the firing pin 128 is held to the body 101 by the sear 139, and hence it cannot move with the breech block. Thus as the pin 170 comes adjacent the projection 168 the pin 170 can retract into the recess 171 in the firing pin to clear the projection. When the firing pin is freed from the sear, the flank of the firing pin once again contacts the inner end of the pin 170 to hold it locked fully outwards, but now the pin 170 is in front of the projection 168. As the breech block and firing pin are retracted by the spring 137 on release of the trigger, the extractor is thus held to the breech block by the pin 170 engaging in front of the projection 168. Since the rim of the round is caught behind the hook 167, the spent case is withdrawn with the breech block until it clears the cheeks 114 and comes into line with the slots 113. The loading catch 118 is held down to permit this extraction to occur, as explained hereinafter. When the rim clears the cheeks 114 there is no influence restraining the spent case against the bias of the spring 109, and the spent case in thus ejected automatically through the opening 112. It will be appreciated that if the loading catch were not held down during this extraction sequence the upper and lower round are held in contact with one another by the spring 109. However, because it is held down, the loading catch 118 itself in turn holds down the lower round so that the rim of the upper round can slide rearwardly and upwardly over the upper surfaces of arms 121, thus clearing the lower rim. The function of the loading catch is thus seen to be an exceedingly important one. In its absence, the spent case would be prevented by contact of its rim with the rim of the lower round, from retracting fully, and hence could not be ejected.

As soon as the spent case is ejected, the forward end of the extractor is free to move inwards under the influence of the spring 164 and the plunger 166 on its rear end. The resulting small rotation of the extractor is sufficient to enable the projection 168 to clear the pin 170 so that the extractor snaps back immediately (ie before the next round can rise into the breech to obstruct the forward movement of the extractor) to its forward position relative to the breech block, as shown in FIG. 4.

In order to permit extraction of the spent case, the loading catch 118 must be held down whilst the case is moved rearwards. This is achieved by the pin 155. When the breech block is moving forward to locate the round in the socket 117, the head 156 of the pin 155 can enter the cam slot 158 in the firing pin, so that the pin can retract when its outer end contacts the loading catch 118. As the breech block completes its forward movement the underside of the breech block contacts the arms 121 to depress the loading catch 118, but the pin 155 plays no part in this. However, when the firing pin is released from the sear 139, the pin head 156 is cammed outwardly by the rounded end of the cam slot 158, so that by the time the firing pin strikes the percussion cap 77, the pin 155 is held fully extended on the flank of the firing pin. In this position, with the breech block fully forward, the extended pin 155 contacts a flat upper forward surface of the catch 118 to hold the catch depressed so that the limbs 121 can pass under the rim 75 of the round being extracted and hold down the rim 75 of the next succeeding live round. As the firing sequence is completed, the breech block and firing pin are withdrawn in unison, with the pin 155 hence still extended. This rearward movement first clears the breech block of contact with the loading catch 118, but the catch cannot rise again to the position shown in FIG. 3 until the breech block has withdrawn far enough for the pin 155 to enter the arcuate portion 123, by which time the spent case has passed rearwardly clear of the arms 121. It will be seem that the arrangement described has the great advantage of countering the possibility that a round which has not been fired will be accidentally ejected.

When the spent case is ejected, if there is no further round present in the magazine, the magazine platform rises under the influence of the spring 109 until restrained by contact with the overhanging portion 115. If, however, a further round is present it is urged upwardly by the spring 109. As it moves upwards, it is guided forwardly by curved under-surfaces of the limbs 121 of the loading catch 118, and at its forward end on the chamfered surface 116. The next round thus moves up in front of the loading catch 118 so that it is held captive by the cheeks 114 and the overhanging portion 115. A further firing sequence can then be initiated immediately by operation of the trigger, or alternatively the magazine can be re-filled by insertion of one or more rounds through the opening 112.

We claim:

1. A firearm including a body (101) and having a magazine characterised in that one or more rimmed rounds (74) of ammunition may be stacked each in contact with an adjacent round; resilient magazine bias means (109);

a breech opening (112) through which a round of ammunition may be inserted into the magazine, the breech opening defining transverse guide means (113, 114) through which a round can be inserted in a direction transversely of the barrel axis against the action of the magazine bias means, and restraining means (114,115) which are effective on subsequent forward movement of the inserted round to restrain the round in the breech against the action of the magazine bias means;

a catch (118) which can assume a locking position in which it prevents return of a round forwardly located in the breech to a position in which it can re-enter the transverse guide means; further guide means (116) by which a round in the breech can be guided in a direction transversely of the barrel axis and rearwardly into the magazine against the magazine bias means on insertion of a further round into the breech;

the catch (118) being effective to keep separate the rims of one round (74) and a subsequently inserted round during the insertion of the subsequently inserted round, whereby the subsequently inserted round when engaged in the breech has its rim forward of the rim of the said one round.

2. A firearm according to claim 1 characterised in that the catch (118) is pivotally mounted in the body and resiliently biased towards the locking position, the arrangement being such that an insertion of a round (74) through the transverse guide means (113,114) the catch is depressed against a resilient bias (120) by contact with the round, and on forward movement of the inserted round the catch can spring back under its resilient bias to prevent rearward movement of the round to a position in which it can re-enter the transverse guide means.

3. A firearm according to claim 1 or claim 2 characterised in that the catch (118) when depressed bears upon any round which is already present in the breech to keep the rim (75) thereof separate from the rim of a subsequently-inserted round.

4. A firearm according to claim 1 characterised by a breech block (125) which can move forwardly to positively lock a round present in the breech in engagement with the breech end (117) of the barrel, and a firing pin (128) moveable forwardly to strike the rear face (76) of a round only when the breech block is in a forward position, and wherein the firing pin has a mechanical interaction (155) with the catch (118), such that the catch is held depressed when the firing pin is in a forward position.

5. A firearm according to claim 1 characterised by an extractor assembly comprising, an extractor (159) having a longitudinal slot (160) therein by which the extractor is pivotally mounted on the breech block (125);

a hook portion (167) at the forward end of the extractor for engaging in front of the rim (75) of a round of ammunition in the breech; resilient means (164) for biasing the extractor forwardly and for biasing the hook portion inwardly towards contact with a round of ammunition in the breech;

a first extractor stop (169) for limiting forward movement of the extractor relative to the body (101) to a position where the extractor hook (167) engages in front of the rim of any round present in the breech, extractor locking means (170) for locking the extractor against longitudinal movement relative to the breech block when the breech block is withdrawn rearwardly after firing a round of ammunition, said extractor locking means being released when the breech block reaches a rearward position whereby the extractor can return under its resilient bias to a position in which the hook engages in front of the rim of a round subsequently entering the breech.

6. A firearm according to claim 5 characterised in that the locking means comprises a locking pin (170) slideable transversely in the breech block, one end of the locking pin being arranged to contact a cam surface (171) on the firing pin such that when the firing pin occupies a forward position relative to the breech block, the locking pin is extended to a position in which its other end can come against a second extractor stop (168) on the extractor but when the firing pin occupies a rearward position relative to the breech block, the locking pin can retract to clear the second extractor stop, the arrangement further being such that if the hook portion moves inwardly under its resilient bias, as when no round is present in the breech, the locking pin can clear the second extractor stop regardless of the position of the firing pin.

* * * * *